United States Patent [19]

Yazawa et al.

[11] Patent Number: 4,801,219

[45] Date of Patent: Jan. 31, 1989

[54] SYSTEM FOR COMPACTING PAVED SURFACES

[75] Inventors: Masayuki Yazawa, Chiba; Mitsuo Fukukawa, Saitama; Kazumitsu Asai, Saitama; Yoshiharu Okamoto, Saitama, all of Japan

[73] Assignees: Kajima Corporation; Kajima Road Company, both of Tokyo, Japan

[21] Appl. No.: 65,438

[22] Filed: Jun. 23, 1987

[30] Foreign Application Priority Data

Jun. 27, 1986 [JP] Japan ..... 61-149652

[51] Int. Cl.[4] ..... E01C 19/23

[52] U.S. Cl. ..... 404/125; 404/127

[58] Field of Search ..... 404/127, 125, 122, 84; 172/2, 518

[56] References Cited

U.S. PATENT DOCUMENTS

| | | | |
|---|---|---|---|
| 811,909 | 2/1906 | Dunham | 404/125 |
| 1,270,087 | 6/1918 | Wright | 404/125 |
| 3,146,686 | 9/1964 | Grace et al. | 404/127 |
| 4,699,543 | 10/1987 | Mio et al. | 404/127 X |

FOREIGN PATENT DOCUMENTS

| | | | |
|---|---|---|---|
| 113022 | 2/1969 | Denmark | 404/125 |
| 575292 | 4/1958 | Italy | 404/125 |

*Primary Examiner*—Stephen J. Novosad
*Assistant Examiner*—Matthew Smith
*Attorney, Agent, or Firm*—Beveridge, DeGrandi & Weilacher

[57] ABSTRACT

A compactor having the roller shafts mounted for changing the inclination of the roller through a linkage system. The compactor is connected to an anchor vehicle by a tension member which deters lateral shifting and has a sensor indicating the inclination angle. The sensor is connected to a control which varies the tension.

4 Claims, 1 Drawing Sheet

FIG. 1
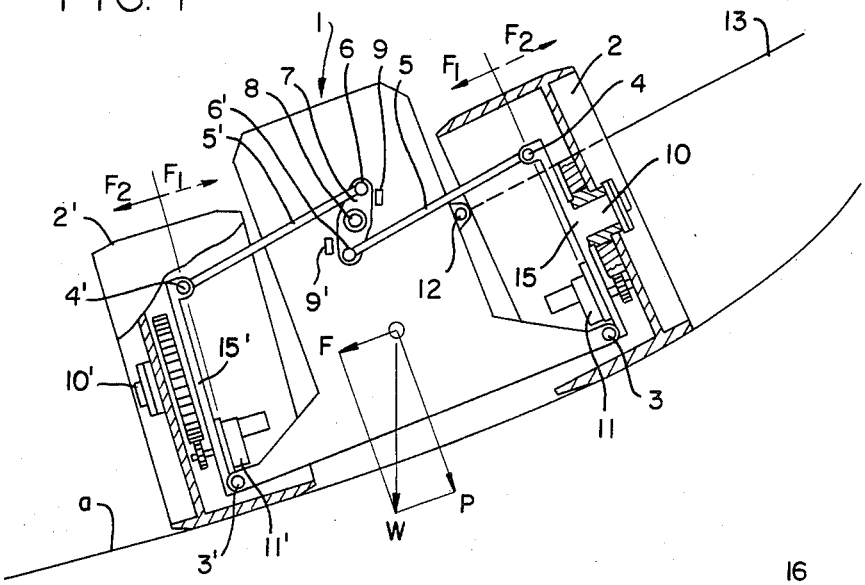
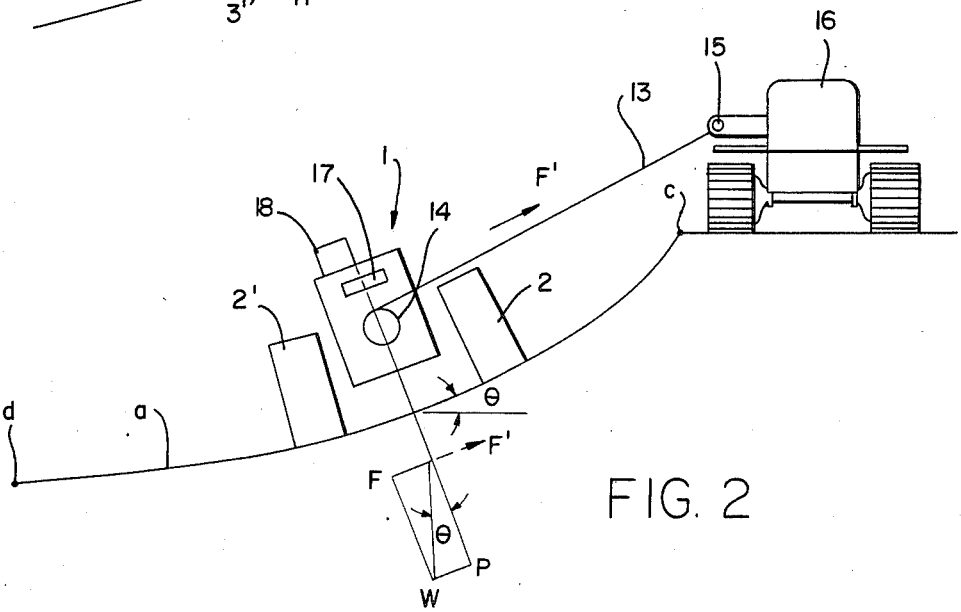
FIG. 2

SYSTEM FOR COMPACTING PAVED SURFACES

BACKGROUND OF THE INVENTION

The present invention relates to the compaction of paved surfaces which have an inclined and/or curved profile in vertical cross section. A typical surface in this category is an asphalt automotive test track.

As is well known, a slope face is paved by laying a paving material on a graded slope with a machine known in the art as an asphalt finisher or "paver." Then, the laid asphalt is compacted by a vehicle known as a "roller" which has steel wheels or rubber tires. As shown in FIG. 4, a roller vehicle B runs on a slope face D, performing the compacting work while it is connected to and supported by a wire W which extends from an anchor vehicle A which runs along the top of the slope.

In a test course for automobiles, the roadbed is generally paved by machines which move in the travel direction of the test course. The compacting rollers and the like are run in the same travel direction to perform the roller-pressurizing work.

Since the test course has a special three-dimensional curved surface, the radii of curvature of the curved surfaces of the slope bottom portion and of the slope shoulder portion largely differ across the width of each profile of the course, i.e. in each vertical plane which is transverse to the longitudinal travel direction. These radii also sequentially vary from one profile to another taken along the course. Therefore, it is fairly difficult to roller-pressurize a curved surface to conform accurately to the designed profile. In particular, if the pressure-applying surfaces of steel roller wheels do not completely coincide with the surface of the asphalt mixture, the shape of the curved surface may change after it is rolled and an accurate paved surface cannot be obtained. Conventional compacting systems do not have wheels capable of conforming to the surfaces with curved profiles.

In an apparatus for rolling curved surfaces disclosed in the Official Gazette of Japanese Patent Publication No. 3024/1969 (JP-B 44-3024), the wheels are forcedly inclined by an hydraulic cylinder. Therefore, no problem will occur if the designed radius of curvature of the roadway profile is constant. If the radius of curvature sequentially varies from one position to another along the length of the roadway as in an easement curve portion of a test course, it is necessary to continuously change the angles of inclination of the wheels in accordance with the movement of the roller vehicle in its longitudinal direction of travel. However, it is extremely difficult to control the pressure of the hydraulic cylinder in such a manner.

When a roller is supported from an anchor vehicle by a wire on an ordinary hydraulic winch, the distribution of weight on the right and left wheels will differ due to the inclination of the roller main body, thus preventing uniform roller pressurization. Therefore, it is necessary to offset the deflected load of the roller by the tension of the wire rope of the winch. However, since the tension of a conventional winch is adjusted by manually operated controls, equal distribution of weight on the left and right wheels cannot be accurately maintained.

SUMMARY OF THE INVENTION

Acccording to the invention, an apparatus for compacting a paved curved surface comprises a vehicle body with right and left shafts mounted thereon so as to be variably inclinable relative to each other and to the vehicle body. Right and left wheels are rotatable and are mounted on the respective shafts, and the apparatus has means for changing the inclinations of the right and left shafts in opposite directions relative to the vehicle body.

Preferably the shafts are connected to the body by left and right members which each have a lower portion connected to the vehicle body. A link-moving means is connected to left and right links which, in turn, are connected to upper portions of the left and right shaft-supporting members. The link-moving means moves the links relative to the vehicle body and to change the inclinations of the shafts. The link moving means may be a pivoted member with opposite arms which are connected to the links.

The vehicle body is connectible to a tension member which deters lateral slipping of the vehicle body on the paved surface. Sensor means are provided on the vehicle body for providing signals which indicate the inclination angle of the vehicle body, and a control means is provided to change the tension of the tension member in response to signals from the sensor means. In use, an anchor vehicle is connected to the vehicle body by the tension member.

BRIEF DESCRIPTION OF THE DRAWINGS

FIG. 1 is a cross sectional view with a part cut away showing the main components of a compacting vehicle which embodies the present invention.

FIG. 2 is a diagrammatic view which includes a vector diagram illustrating the pressure equalizing feature of the invention.

FIG. 3 is a block diagram of a control unit which is used in the invention.

FIG. 4 is an explanatory diagram of a worksite where a slope face is being compacted.

DETAILED DESCRIPTION

In FIG. 1, wheels 2 and 2' are attached to the right and left sides of the main body 1 of the roller vehicle. In this case, the wheels 2 and 2' are rotatably mounted on the shafts 10 and 10', respectively. Bar members 15 and 15' are integrally attached with the shafts 10 and 10', and they are mounted on the vehicle body 1 in a manner which enables them to be freely inclined with respect to the main body 1. Pivot pins 3 and 3' attach the lower portions of the bars 15 and 15' to the body 1. Balance links 5 and 5' have their outboard ends coupled by pins 4 and 4' to the upper end portions of the bars 15 and 15'. The inboard ends of the balance links 5 and 5' are coupled by pins 6 and 6' to arms on opposite sides of a link 7. The link 7 has its center pivotally connected to the main body 1 by a pin 8.

The wheels 2 and 2' can automatically follow along the curved pavement surface a without intervention by the machine operator.

The balance links 5 and 5' and the link 7 constitute a link mechanism which offsets the overturning components of forces Fl and F2 which are exerted on the wheels 2 and 2' by the inclined ground. Without the link mechanism, the wheels 2 and 2' will slip laterally due to the overturning components of force in the steep inclined ground, or a large difference will occur between the pressures at the opposite edges of the wheels, so that the roller-pressurizing work cannot be performed.

Stops 9 and 9′ are affixed to the body 1 to limit the movement of the link 7, thus preventing the wheels 2 and 2′ from inclining so far that they come into contact with the main body. Numerals 11 and 11′ denote hydraulic motors for driving the vehicle, and 12 represents a supporting point on the roller main body 1 which is connected to the anchor wire 13.

The right and left wheel shafts can follow the curved surface, and the link mechanism always locates the vehicle body at the center between the right and left wheels, so that the roller-pressurizing forces exerted by the right and left wheels are equal. Even if the surface curvature changes, the link mechanism moves the shafts and wheels in opposite directions to prevent any unbalanced roller pressures due to the curved surface.

As shown in FIG. 2, the main body 1 of the roller carries a hydraulic winch 14, an inclination angle sensor 17, and a hydraulic control unit 18. The roller 1 is coupled to and supported by the anchor wire 13 which is connected to a supporting point 15 on an anchor vehicle 16.

In operation, when the roller main body 1 runs on the inclined surface, a component F of the weight W of the vehicle body is generated in proportion to the inclination angle $\theta$ of the roller body 1. Therefore, two machines can be supported by the wires 13 from the anchor vehicle 16 and they are run in parallel with the anchor vehicle 16 to prevent the main body 1 of the roller from falling down, overturning or slipping transversely. Differential roller pressures are prevented by applying the deflected loads to the right and left wheels 2 and 2′.

In this case, by adjusting the tension F′ of the wire 13 so it is equal and opposite to the component F, only the force P which is perpendicular to the inclined surface acts on the roller body 1. Thus, the roller body 1 runs under conditions which are the same as if it were running on a flat horizontal surface. In this state, the roller body 1 is steerable by operating its steering wheel or handle. It can be steered toward the slope shoulder c or slope bottom d, thus changing its position on the slope. This mobility is irrespective of changes in the inclination of the roller body 1. Moreover, the forces applied to and by the right and left wheels 2 and 2′ are uniform and equal.

In conventional systems for supporting a roller main body, a hydraulic winch on an anchor vehicle is wound up or down in response to instructions from the operator of the roller vehicle 1, thereby changing the transverse position of the roller main body 1. Therefore, the wire is frequently too taut or too slack. Uniform roller pressurization is not possible due to the deflected loads to the right and left wheels 2 and 2′. Further, there is a danger that the roller main body may slip or overturn due to incorrect or misunderstood instructions between the roller operator and the anchor vehicle operator.

FIG. 3 shows an example of a unit for controlling the apparatus so the tension F′ of the wire 13 will equal the force component F. In this drawing, solid lines represent hydraulic connections, and broken lines represent electrical connections. A voltage signal proportional to the inclination angle 0 is generated by the inclination angle sensor 17 on the roller vehicle. This signal is amplified by a command signal converter 20 and output as a command signal to a proportional electromagnetic relief valve 22. This gives a constant proportional relation between the command signal and the hydraulic pressure which is supplied to a hydraulic motor 21.

A variable hydraulic pump 23 is driven by a prime mover E to supply the hydraulic pressure to the hydraulic motor 21 through a change-over valve 24, thereby forwardly or reversely rotating the hydraulic winch 14. The hydraulic pressure of the motor 21 is detected by a pressure sensor 25 of the electromagnetic relief valve. At the same time, this hydraulic pressure is reduced to a predetermined pressure by a proportional electromagnetic valve 26 in response to a signal from a servo amplifier 27. Hydraulic fluid released by the valve 26 is returned to a hydraulic tank T.

The hydraulic pressure which is supplied to the hydraulic motor 21 can be automatically adjusted to be proportional to the inclination angle 8 of the roller body as described above. The control pressure is also detected by the pressure sensor 25 and the detection signal is returned to the control unit. The relation between the inclination angle 8 of the roller main body 1 and the pressure to be supplied to the hydraulic motor 21 is previously calculated and set and, thereafter, it can be confirmed and adjusted experimentally.

When the tension of the wire is controlled in response to the angle of inclination of the vehicle body, to balance against the gravitational component of force in the direction perpendicular to the slope face due to the inclination, the roller-pressurization can be performed so that constant and equal forces are exerted by the left and right compactor wheels.

We claim:

1. Apparatus for compacting a paved curved surface, comprising, a vehicle body, a right shaft and a left shaft mounted on said vehicle body, said shafts being variably inclinable relative to each other and to the vehicle body, a right wheel and a left wheel which are rotatable and are mounted on said right shaft and said left shaft, respectively, said shafts being connected to left and right members each of which has an upper portion and a lower portion, pivot pins coupling said lower portions to the vehicle body, left and right links connected by pins to said upper portions of the left and right members respectively, a pivoted member pivoted on the body by a pin, said pivoted member having opposite arms connected by pins to the left and right links, the pivoted member moving said left and right links relative to the vehicle body so as to change inclinations of said right and left shafts in opposite directions relative to each other and relative to said vehicle body.

2. Apparatus according to claim 1 in combination with an anchor vehicle, and a tension member connecting said anchor vehicle to said vehicle body.

3. Apparatus according to claim 1 having a tension member connected to the vehicle body to deter lateral slipping movement of the vehicle body on the paved surface, sensor means on said vehicle body for providing signals which indicate the inclination angle of the vehicle body, and control means for changing the tension of said tension member in response to signals from said sensor means.

4. Apparatus as claimed in claim 3 having an anchor vehicle which is connected to said vehicle body by the tension member.

* * * * *